US009038355B2

(12) United States Patent
Honegger

(10) Patent No.: US 9,038,355 B2
(45) Date of Patent: May 26, 2015

(54) METHOD AND APPARATUS FOR UNFOLDING FOLDED PLASTIC FILM FOR USE IN FORMING A PACKAGING TUBE

(75) Inventor: Chris Allen Honegger, Bluffton, IN (US)

(73) Assignee: Rethceif Enterprises, LLC, Bluffton, IN (US)

( * ) Notice: Subject to any disclaimer, the term of this patent is extended or adjusted under 35 U.S.C. 154(b) by 170 days.

(21) Appl. No.: 13/373,201

(22) Filed: Nov. 8, 2011

(65) Prior Publication Data

US 2013/0097976 A1 Apr. 25, 2013

Related U.S. Application Data

(62) Division of application No. 13/317,572, filed on Oct. 21, 2011.

(51) Int. Cl.

| | |
|---|---|
| ***B65B 9/10*** | (2006.01) |
| ***B65B 9/13*** | (2006.01) |
| ***B65B 59/02*** | (2006.01) |
| *B65B 9/22* | (2006.01) |
| *B65B 39/02* | (2006.01) |
| *B65B 9/06* | (2012.01) |

(52) U.S. Cl.

CPC ... *B65B 9/10* (2013.01); *B65B 9/22* (2013.01); *B65B 9/13* (2013.01); *B65B 39/02* (2013.01); *B65B 59/02* (2013.01); *B65B 2009/063* (2013.01)

(58) Field of Classification Search

CPC ..... B65B 9/00; B65B 9/06; B65B 9/12; B65B 9/22; B65B 11/02; B65B 43/26; B65B 53/00; B65B 41/12; B65B 61/10; B65B 9/10; B65B 9/13

USPC ..... 53/450, 461, 463, 550, 553, 269, 459, 53/564, 568, 308, 302, 268, 492–493, 552, 53/204, 389.2, 177, 381.1

See application file for complete search history.

(56) References Cited

U.S. PATENT DOCUMENTS

| | | | | |
|---|---|---|---|---|
| 3,274,746 | A | 9/1966 | James et al. | |
| 3,415,171 | A | 12/1968 | Wilson | |
| 3,431,831 | A * | 3/1969 | Hardee et al. | 493/302 |
| 3,538,899 | A * | 11/1970 | Burkett | 123/182.1 |
| 3,732,789 | A * | 5/1973 | Hartleib | 493/302 |

(Continued)

OTHER PUBLICATIONS

YouTube video https://www.youtube.com/watch?v=kb4G1MnC9U8 at 3:28-41 uploaded by Polypack, Inc. on May 10, 2011; screen printout of video at 3:29.

*Primary Examiner* — Thanh Truong
*Assistant Examiner* — Justin Citrin
(74) *Attorney, Agent, or Firm* — George Pappas

(57) ABSTRACT

An apparatus for unfolding folded plastic film having a first side joined to a second side along a longitudinal folded edge for use in forming a packaging tube. The folded film travels through a slot and the folded sides are separated at their respective outer longitudinal edges. The longitudinal left side is conveyed toward and over a guide plate left side edge and then over a left form tube section. The longitudinal right side is conveyed toward and over a guide plate right side edge and then over a right form tube section. The longitudinal middle section including the longitudinal folded edge and part of both the first and second sides adjacent the longitudinal folded edge is conveyed toward and over guide plate angular edges and then onto a carrying surface.

29 Claims, 17 Drawing Sheets

(56) References Cited

U.S. PATENT DOCUMENTS

| | | | | |
|---|---|---|---|---|
| 4,381,637 | A | 5/1983 | Ballestrazzi et al. | |
| 4,490,962 | A | 1/1985 | Weis et al. | |
| 4,663,915 | A | 5/1987 | Van Erden et al. | |
| 4,671,047 | A | 6/1987 | Mugnai | |
| 4,761,937 | A | 8/1988 | Francioni | |
| 5,165,221 | A | 11/1992 | Udelson et al. | |
| 5,255,495 | A | 10/1993 | Kovacs | |
| 5,269,119 | A | 12/1993 | Tolson | |
| 5,367,859 | A | 11/1994 | Suga | |
| 5,799,467 | A | 9/1998 | Nankervis et al. | |
| 5,987,860 | A | 11/1999 | Yang | |
| 6,599,389 | B1 | 7/2003 | Uneda | |
| 6,662,527 | B1 | 12/2003 | Suga | |
| 6,845,602 | B2 * | 1/2005 | Drut | 53/551 |
| 6,938,393 | B2 | 9/2005 | Timmerman et al. | |
| 7,328,545 | B2 | 2/2008 | Koppen et al. | |
| 7,694,499 | B2 | 4/2010 | Ballestrazzi et al. | |
| 2005/0235605 | A1 | 10/2005 | Ballestrazzi et al. | |
| 2006/0179798 | A1 | 8/2006 | Thorpe | |
| 2009/0229226 | A1 | 9/2009 | Beeland et al. | |

* cited by examiner

METHOD AND APPARATUS FOR UNFOLDING FOLDED PLASTIC FILM FOR USE IN FORMING A PACKAGING TUBE

This is a divisional of and claims priority of application Ser. No. 13/317,572 filed Oct. 21, 2011 the disclosure of which is incorporated herein by reference.

BACKGROUND OF THE INVENTION

1. Field of the Invention

The present invention relates to the field of packaging machines and, more particularly, to packaging machines that utilize a plastic film directed from a plastic film roll to envelop and package a variable sized article. More particularly, the present invention relates to apparatus and methods for unfolding an elongate folded plastic film web for use in forming a plastic film tube which may then be used to envelop large articles such as bales of cotton, trash, cloth, etc.

2. Background

It is desirable to package and/or envelop bulk materials such as insulation, trash, cloth, scraps, recyclables, etc. that have been pre-bundled into a bale with a plastic film. However, such bales are typically fairly large and, as a consequence, require large sheets/webs of plastic film capable of surrounding the bales.

Plastic film is manufactured and is readily available in long/elongate webs which are wound and provided on rolls. The elongate web can be formed into a continuous elongate plastic film tube in a manner whereby articles can be inserted therein. The tube can then be separated and sealed between the articles for thereby enveloping the articles with the plastic film. The tube is formed by unwinding the plastic film from the roll and shaping it into a tube wherein the width of the web becomes the circumference of the tube (less any overlap of the web edges). Hence, the width of the tube establishes and is the limiting factor in the size/circumference of the plastic film tube. As can be appreciated, the width of the web must be fairly large to be able to form a sufficiently large size/circumference tube to envelop large articles such as the aforementioned bales.

Additionally, the width of the web as it is wound on the roll establishes the length of the roll. Excessively long rolls are difficult to produce, are bulky and become unmanageable. By folding the plastic film web along a longitudinal folded edge the length of the roll can be cut in half and the overall width of the web can be sufficient for forming a large enough size/circumference plastic film tube for enveloping large articles such as the aforementioned bales.

Accordingly, a need exists for an apparatus and method of unfolding folded plastic film for use in forming a packaging plastic film tube.

SUMMARY OF THE INVENTION

In one form thereof the present invention is directed to an apparatus for unfolding a folded plastic film for use in forming a tube. The plastic film includes a first side joined to a second side along a longitudinal folded edge and each side includes an outer longitudinal edge. The apparatus includes an elongate slot adapted to receive the plastic film. A guide plate is provided adjacent the elongate slot and includes a forward end and a left and a right side edge. An elongate guide member is provided adjacent the guide plate. After the plastic film is received through the elongate slot, part of the first side of the plastic film travels toward and over the guide plate left side edge, and part of the second side of the plastic film travels toward and over the guide plate right side edge. The longitudinal folded edge and part of both the first and second sides of the plastic film adjacent the longitudinal folded edge travel toward and over the guide plate forward end and around the elongate guide member.

Preferably, the elongate slot is formed with a pair of longitudinally extending rollers which are substantially parallel to each other. The guide plate left and right side edges are preferably substantially parallel to the pair of longitudinally extending rollers. The elongate guide member is preferably substantially perpendicular to the guide plate first and second side edges and is a roller.

The guide plate forward end preferably includes a left angular edge and a right angular edge joined at a forward terminal point, and the left angular edge is joined with the guide plate left side edge and the right angular edge is joined with the guide plate right side edge. In operation, the plastic film longitudinal folded edge travels over the forward terminal point. A barb is provided at the forward terminal point extending toward the elongate slot and between the pair of longitudinally extending rollers.

Preferably, a second guide plate is provided having an edge generally parallel with the elongate guide member such that the plastic film longitudinal folded edge and part of both the first and second sides of the plastic film adjacent the longitudinal folded edge travel over the second guide plate after traveling around the elongate guide member.

Yet more preferably, the apparatus includes a second guide plate adjacent the elongate guide member along with a conveyor adjacent the second guide plate and a forming collar adjacent the conveyor. In operation, therefore, the parts of the first and second sides of the plastic film traveling over the guide plate first and second side edges travel toward and over the forming collar, and the plastic film longitudinal folded edge and part of both the first and second sides of the plastic film adjacent the longitudinal folded edge traveling over the elongate guide member, then further travels toward and over the second guide plate and onto the conveyor. The second guide plate preferably includes a first edge generally parallel with the elongate guide member and a second edge generally parallel with a supporting surface on the conveyor. The conveyor includes a receiving end and an outlet end and is cantilevered with its outlet end being supported and its receiving end extending between the guide plate and the forming collar. The forming collar preferably includes separable left and right form tube sections.

Preferably, the elongate slot is substantially parallel to the guide plate left and right side edges; the elongate guide member is substantially perpendicular to the guide plate left and right side edges; and the elongate guide member is substantially perpendicular to the guide plate first and second side edges.

In another form thereof, the present invention is directed to a method of unfolding a folded plastic film for use in forming a tube, wherein the plastic film includes a first side joined to a second side along a longitudinal folded edge, wherein each side includes an outer longitudinal edge and wherein the sides are parallel and adjacent one another. The method includes the steps of: initially separating the plastic film first and second sides at their respective outer longitudinal edges; conveying a plastic film longitudinal left side comprising part of the first side adjacent its outer longitudinal edge toward and over a guide plate left side edge and then over a left form tube section; conveying a plastic film longitudinal right side comprising part of the second side adjacent its outer longitudinal edge toward and over a guide plate right side edge and then over a right form tube section; and, conveying a plastic film longitudinal middle section comprising the longitudinal folded edge and part of both the first and second sides adjacent the longitudinal folded edge toward and over an angular edge which is located at an angle relative to the guide plate side edges and then onto a carrying surface.

Preferably, after the conveying of the longitudinal middle section over the angular edge and prior to conveying the longitudinal middle section onto the carrying surface, the longitudinal middle section travels over an elongate guide member. Also, after the longitudinal middle section travels over the elongate guide member, it travels along a second guide plate extending between the elongate guide member and the carrying surface. The directions of travel of the plastic film longitudinal middle section prior to and after traveling over the elongate member are preferably substantially perpendicular to one another.

Yet more preferably, prior to the step of initially separating, the folded plastic film travels through an elongate slot. Also, immediately after the step of initially separating, the plastic film longitudinal left and right sides are conveyed in a direction substantially perpendicular to the direction that the plastic film longitudinal middle section is being conveyed. Also preferably, the conveying of the longitudinal middle section toward the angular edge is in a direction opposite that of the conveying of the longitudinal middle section on said carrying surface.

BRIEF DESCRIPTION OF THE DRAWINGS

The above mentioned and other features of this invention, and the manner of attaining them, will become more apparent and the invention itself will be better understood by reference to the following description of the embodiments of the invention taken in conjunction with the accompanying drawings, wherein.

Figure 1:
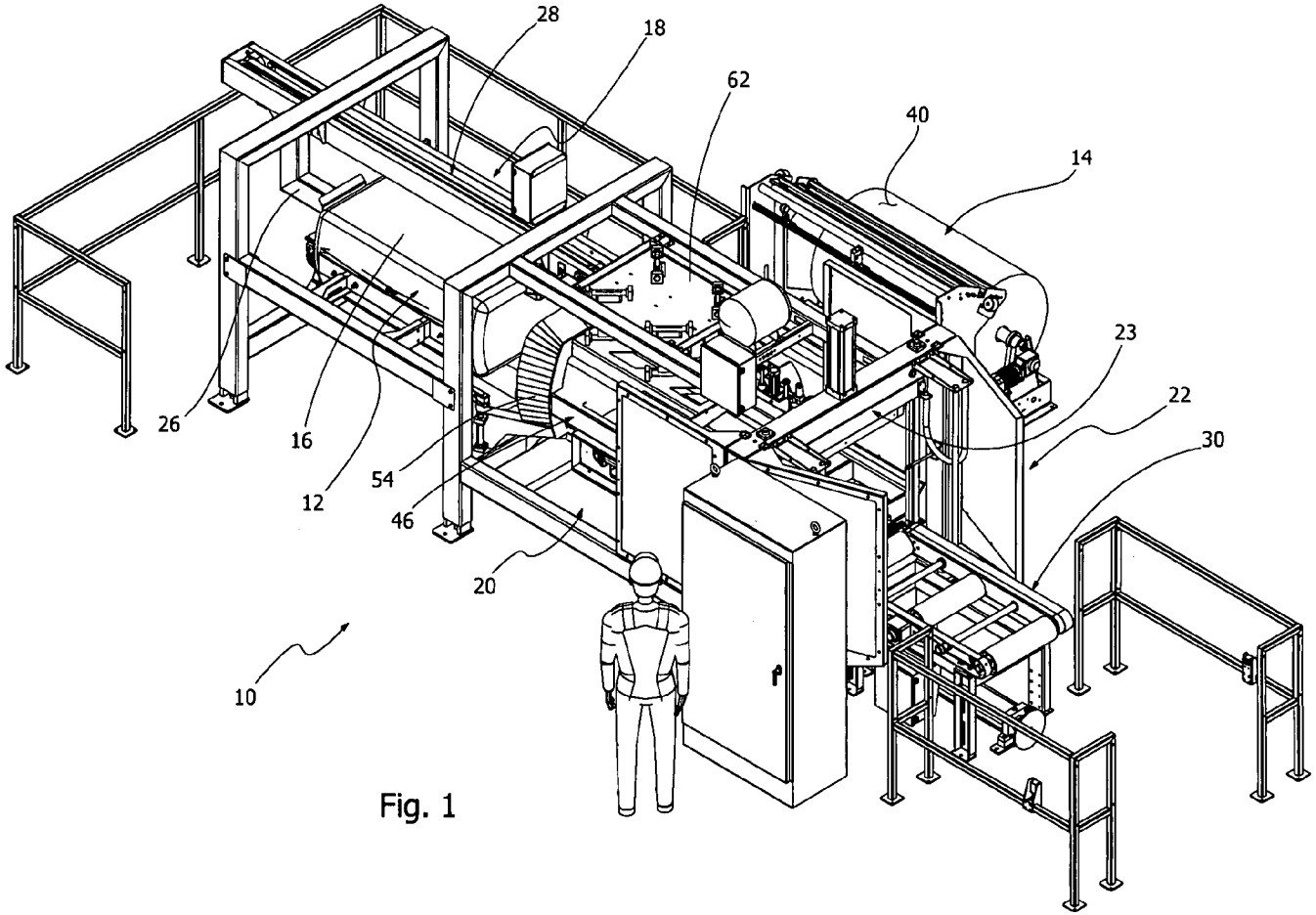
FIG. 1 is a perspective view of a plastic film bale wrapping machine incorporating an apparatus for unfolding folded plastic film and form it into a tube in accordance with the principles of the present invention.

Corresponding reference characters indicate corresponding parts throughout several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE PREFERRED EMBODIMENTS

Figure 2:
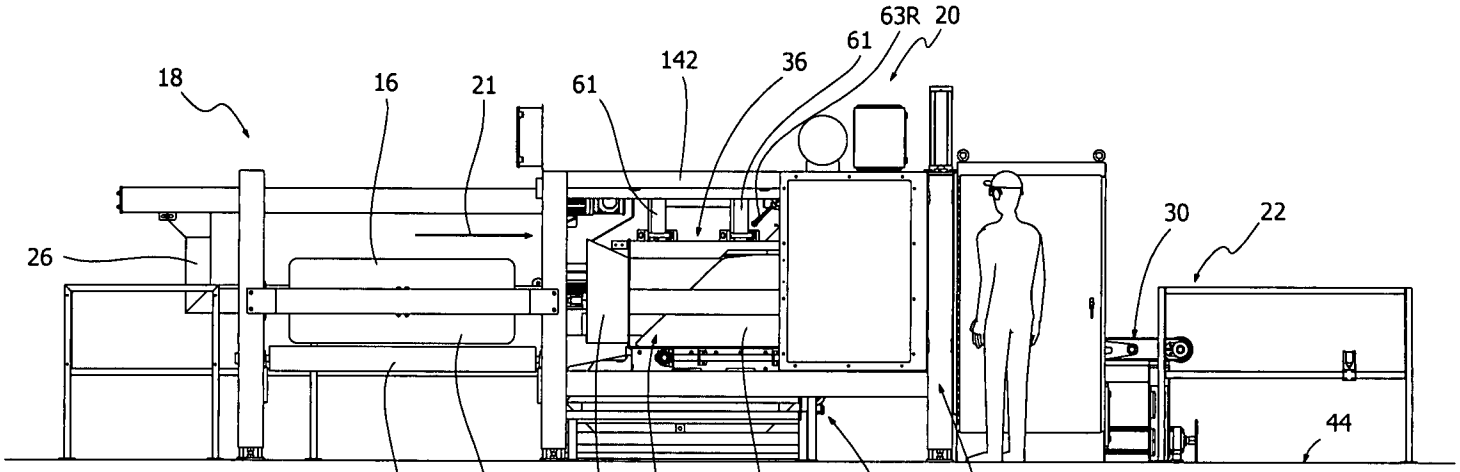
FIG. 2 is a side elevation view of the machine shown in FIG. 1.
Figure 3:
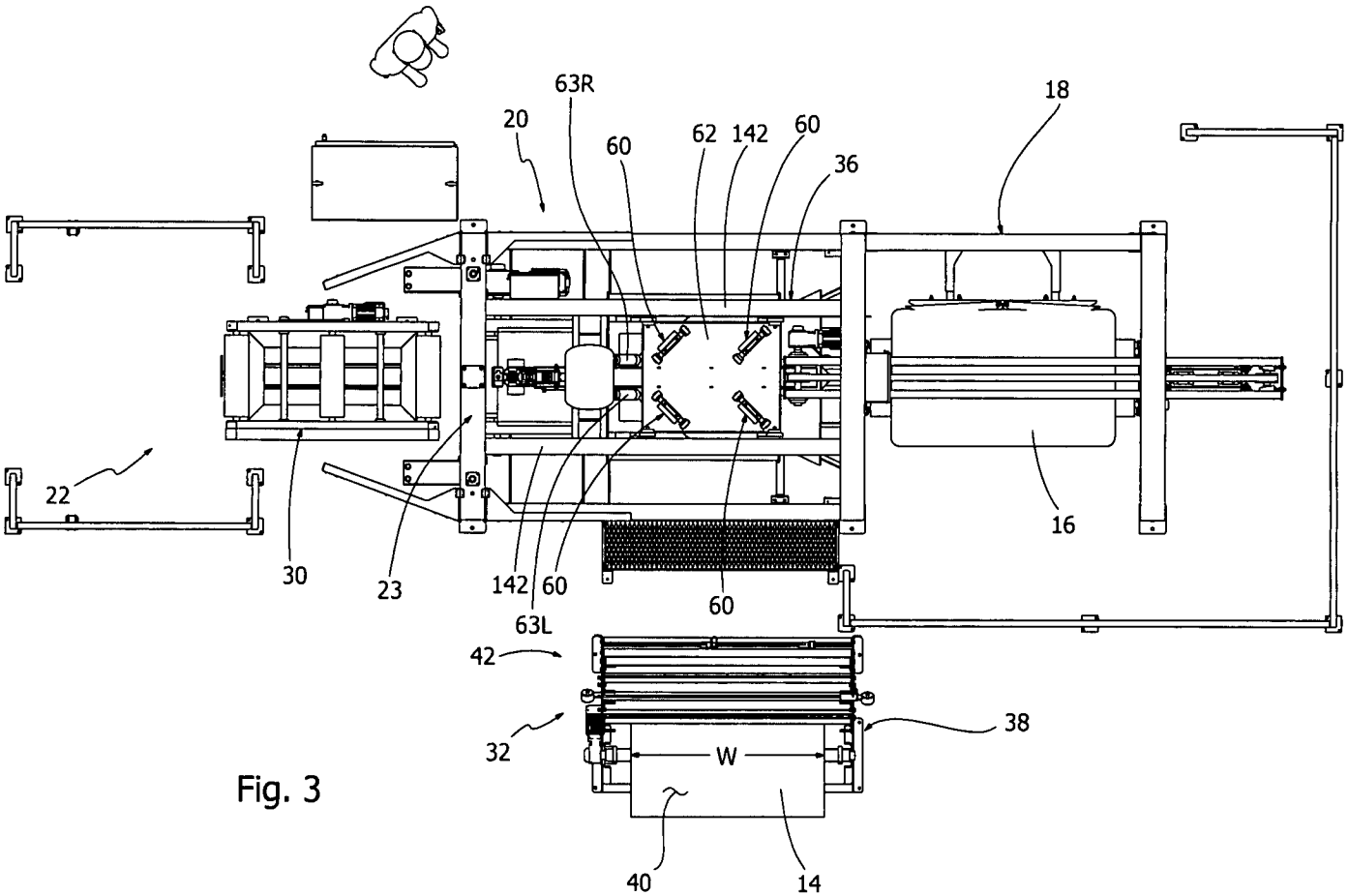
FIG. 3 is a top plan view of the machine shown in FIG. 1.

Referring initially to FIGS. 1 through 3, a bale wrapping machine/apparatus is shown and generally designated by the numeral 10. Bale wrapping apparatus 10 is adapted to wrap articles 12 with plastic film which is provided on plastic film roles 14. Articles 12 can be any product, however, in the preferred embodiment are typically bales 16 of cotton, trash, insulation and other bulk materials which have previously been bound and formed into an elongate rectangular box shape as shown. Bales 16 will generally differ in size (height, width and length) and therefore, bale wrapping apparatus 10 is adapted to accommodate the different height, width and length thereof. Moreover, bales 16 are fairly large and are, for example, in the neighborhood of 21 inches high, by 33 inches wide and 55 inches long, and can weigh in the neighborhood of 500 pounds.

Bale wrapping apparatus 10 includes an infeed section 18, a wrapping section 20 and an output section 22. Bales 16 are wrapped with plastic from role 14 as they travel through the wrapping section 20 in a longitudinal direction depicted by arrow/line 21. Infeed section 18 includes a conveyor 24 whereupon bales 16 may be placed for transport towards and into the wrapping section 20. Conveyor 24 can take the form of an endless belt conveyor or, alternatively, may be a low friction surface or low friction rollers whereupon bales 16 may be placed and then slid towards and into the wrapping section 20. When conveyor 24 is a low friction surface, a ram 26 is provided as shown and selectively longitudinally driven with drive assembly 28 towards the wrapping section 24 thereby pushing the bales 16 towards and into the wrapping section 20.

After the bales 16 have been wrapped or, more particularly, inserted into a plastic film tube 47 formed in the wrapping section 20, they are moved toward the output section 22 whereat they are transported via conveyor 30. Between wrapper section 20 and output section 22, a horizontal sealing section 23 is provided whereby, at each longitudinal end of the enveloped bale, the plastic film tube 47 is sealed in a known and customary manner for thereby fully enclosing or enveloping the bale. The wrapped bales 16 may then be removed from conveyor 30 by forklift or other means and/or can be further transported with other conveyors as needed or desired.

The wrapping section 20 includes a film unwind section 32, a film unfolding section 34 and a tube forming section 36. In the embodiment as shown, the film unfolding section 34 is located vertically below the film tube forming section 36, however, these sections can be located in other orientations relative to one another.

The film unwind section 32 includes a roll support assembly 38 whereupon the plastic film rolls 14 may selectively be placed for use in the bale wrapping apparatus 10. The plastic film 40 is unwrapped from the plastic film rolls 14 and directed toward the unfolding section 34 with a plurality of guide rollers 42. In the preferred embodiment as shown, the plastic film 40 is directed to the film unfolding section 34 generally horizontally over and along the supporting surface 44.

Referring now to FIGS. 4-12, the tube forming section 36 includes a plastic film forming tube or collar 46 whereat a plastic film tube 47 is formed for receipt of the bales 16 therein. Forming tube 46 is generally made up of left and right shoulder sections 48, 50 and the upper conveyor or carrying surface 130 of the endless belt conveyor 129. Left and right shoulder sections 48, 50 are provided with left and right lead-in guides 52, 54 respectively. Forming tube 46 defines an inlet orifice 56, a central volume 57 and outlet orifice 58.

Left and right lead-in guides 52, 54 are, in part, generally conically shaped and flared outwardly away from the inlet orifice 56. Lead-in guides 52, 54 form a "chute" leading into the forming tube central volume 57 that aids to guide bales 16 into the central volume 57 of the plastic film forming tube 46. More importantly, the lead-in guides 52, 54 come in contact with the bales 16 as the bales travel into the inlet orifice 56 and cause the left and/or right shoulder sections 48, 50 to shift and selectively increase the central volume 57 and, hence, the width/size of the plastic tube 47. In this manner, the plastic film tube 47 is selectively increased or decreased in width/size for accommodating variable sized bales.

Figure 7:
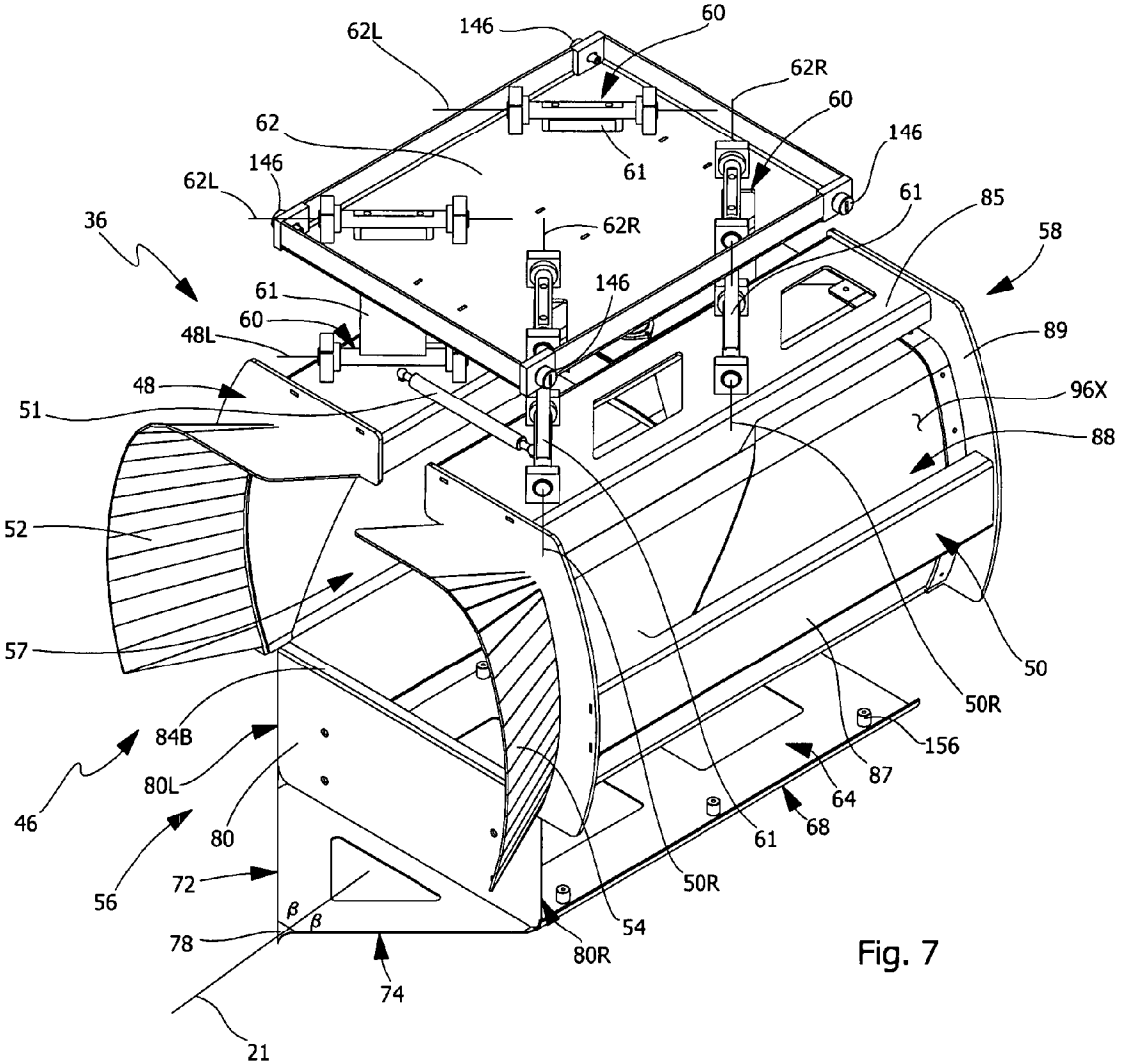
FIG. 7 is a front, right side and top perspective view of the film unfolding section and the tube forming section incorporated in the machine of FIG. 1 (with the wrapper section cantilevered conveyor removed for illustration purposes) and constructed in accordance with the principles of the present invention.
Figure 8:
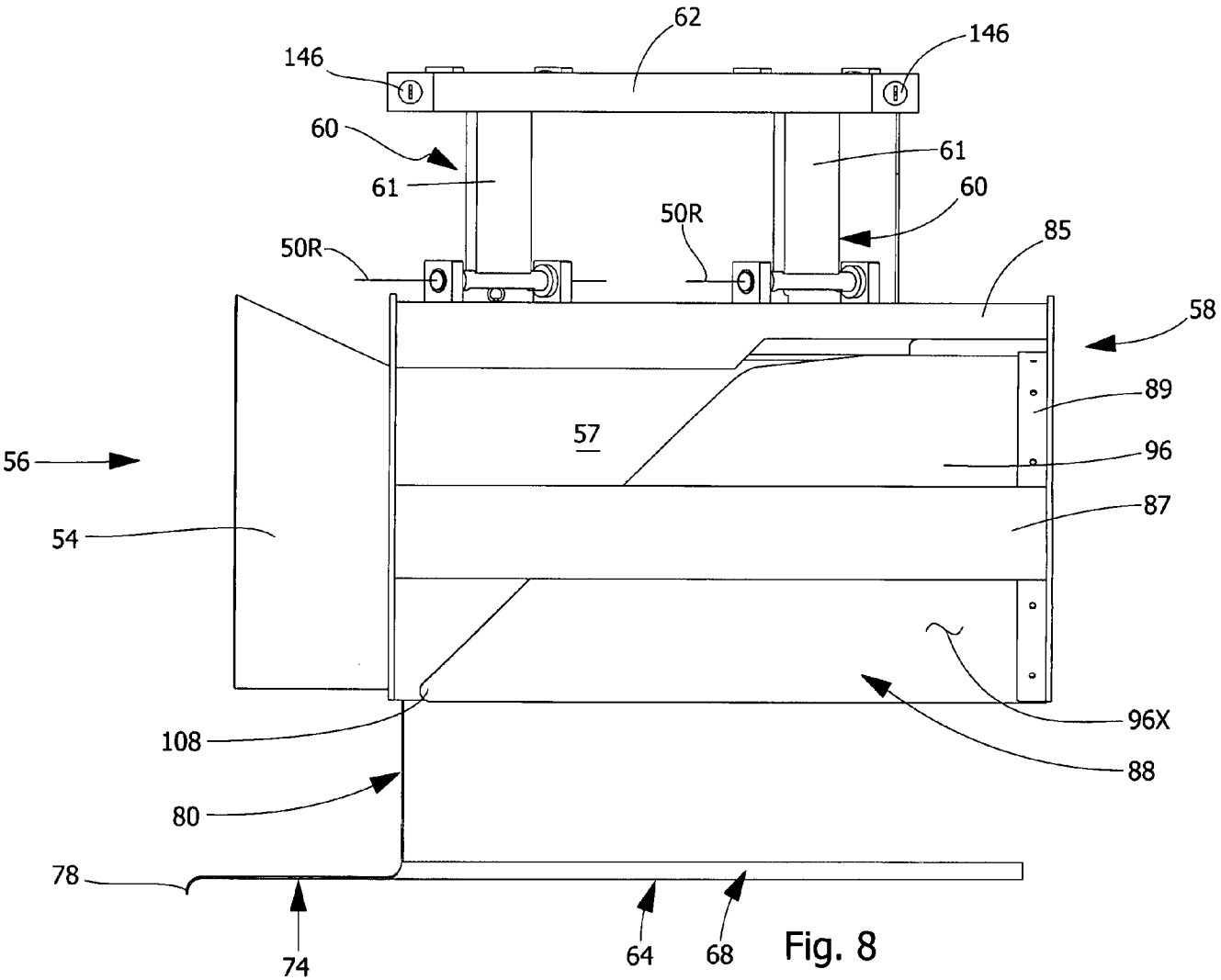
FIG. 8 is a side elevation view of the film unfolding section and the tube forming section shown in FIG. 7.

Left and right shoulder sections 48, 50 are pivotally supported with pivot assemblies 60 from a carrier 62. Pivot assemblies 60 each include an arm 61 pivotally secured at their upper end to the carrier 62 about pivot axes 62R, 62L and pivotally secured at their lower end to a shoulder section 48, 50 about pivot axes 48L, 50R. As best seen in FIG. 7, the pivot axes of each arm 61 are parallel to one another. The pivot axes of each shoulder section 48, 50 are also parallel to one another. That is, pivot axes 62R and 50R are parallel to one another and pivot axes 62L and 48L are parallel to one another. Accordingly, shoulder section 48 is movable in a direction defined by an arc that swings about the pivot axes 62L while being maintained in a generally vertical orientation by pivoting about axes 48L. Similarly, shoulder section 50 is movable in a direction defined by an arc that swings about the pivot axes 62R while being maintained in a generally vertical orientation by pivoting about axes 50R. Additionally, the pivot assemblies 60 allow the left and right shoulder sections 48, 50 to be independently selectively moveable relative to each other. A tension spring mechanism 51 (FIG. 7) is secured between the left and right shoulder sections 48, 50 for biasing the shoulder sections 48, 50 towards each other and, hence, upon or in sliding engagement with bales 16 as the bales 16 travel through the central volume 57 of the forming tube 46.

Figure 12:
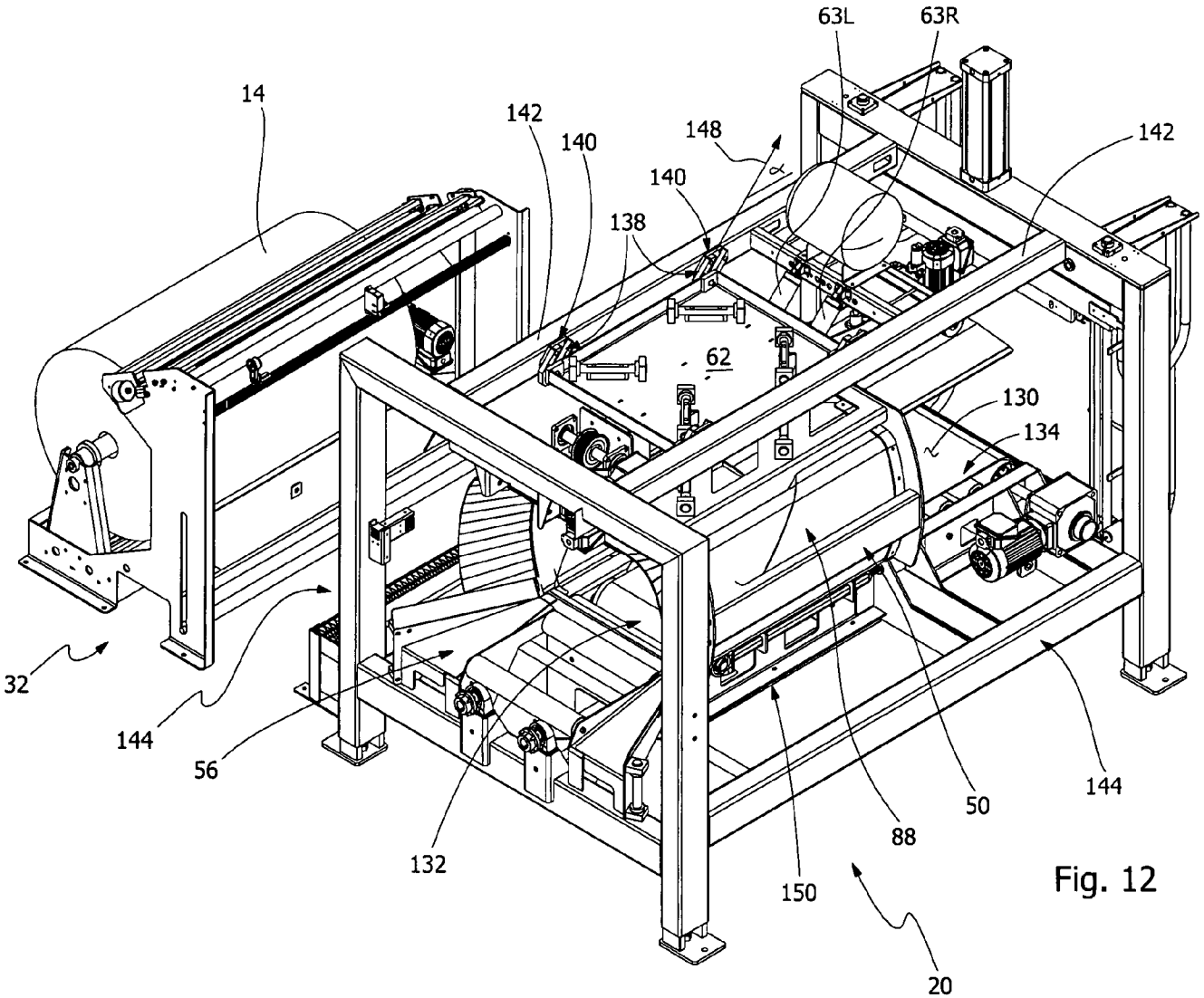
FIG. 12 is a perspective view of the film wrapper/tube forming section and film unwind section constructed in accordance with the principles of the present invention.
Figure 13:
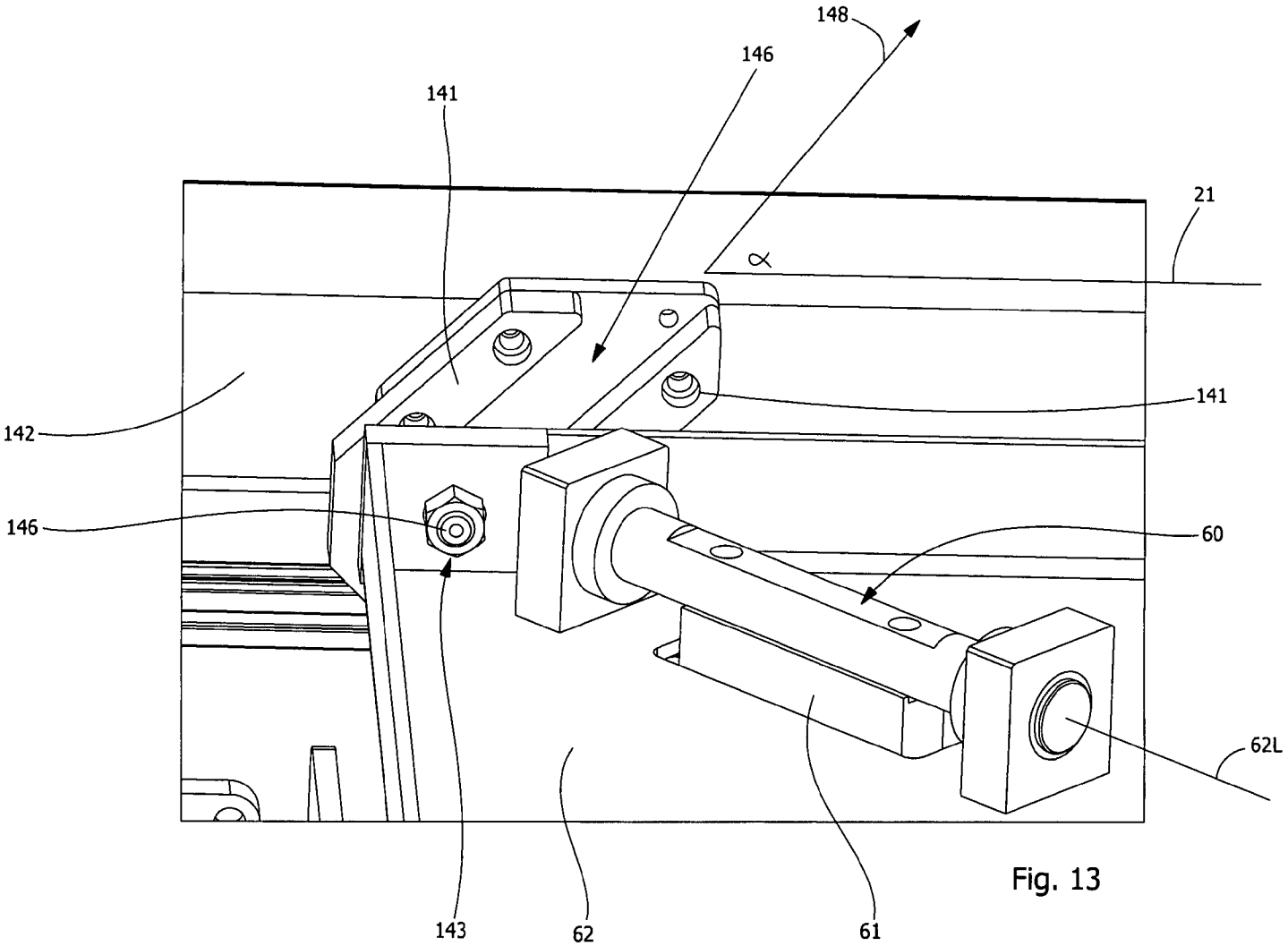
FIG. 13 is a partial perspective view of the forming collar carriage shown in FIG. 12.

As shown in FIG. 12, cam assemblies 138 are provided whereby the carrier 62 is itself also capable of moving vertically upwardly and backwardly away from the conveyor upper surface 130. Cam assemblies 138 include cam slots 140 on the supporting horizontal beams 142 of the wrapper section frame 144. Cam slots 140 are formed between cam rails 141 affixed to the beams 142. Cam slots 140 are sized and adapted to slidingly receive cam roller wheels 146 which are pivotally secured to the carrier 62 with bolts 143. Accordingly, cam roller wheels 146 along with the carrier 62 and the complete forming tube assembly 46 are moveable relative to the wrapper frame 144 in a direction depicted by arrow 148 at an angle $\alpha$ with respect to the horizontal surface 44 and the longitudinal line 21. Left tension spring mechanism 63L is secured between the frame 144 and the left shoulder section 48 and right tension spring mechanism 63R is secured between the frame 144 and the right shoulder section 50 (FIGS. 3 and 12). Left and right tension spring mechanisms 63L, 63R independently bias the left and right shoulder sections 48, 50 respectively downwardly relative to the frame 144 and, hence, upon or in sliding engagement with bales 16 as the bales 16 travel through the central volume 57 of the forming tube 46.

The independent movement of left and right shoulder sections 48, 50 via the pivot assemblies 60 in combination with the movement of the carrier 62 via the cam assemblies 138, as more fully discussed herein below, allows variable size bales 16 to be received through the forming tube 46 and also forms the plastic film tube 47 having a size/circumference as needed for a snug fit around the bales regardless of the bale size.

Left and right form tube shoulder sections 48, 50 include left and right inner form tube sections 86, 88 respectively. The inner form tube sections 86, 88 are each supported on a frame formed by an upper beam member 85, side beam member 87 and rear connecting plate member 89. The upper beam members 85 are pivotally secured to arms 61 at pivot axes 50R, 48L. The lead-in guides 52, 54 are secured to the forward end of beam members 85, 87, whereas the rear connecting members 89 are secured to the rear end of the beam members 85, 87 and to the inner form tube sections 86, 88. Hence, the left and right inner form tube sections 86, 88 are affixed to and supported by the frame members 85, 87 and 89 in the left and right form tube sections 48, 50 respectively and move as described herein above in connection with the left and right form tube sections 48, 50. As more fully described herein below, the plastic film 40 at least partially travels over the inner form tube sections 86, 88 so as to form the plastic film tube 47.

Left inner form tube section 86 includes a left lower inturned lip section 90, a left mid wall section 94 and a left upper crossover triangular section 102. Similarly, the right inner form tube section 88 includes a right lower inturned lip section 92, a right mid wall section 96 and a right upper crossover triangular section 104.

Left and right inner form tube sections 86, 88 are essentially mirror images of one another and both include a forward nosing 98, 100 and rear edges 99, 101. The rear edges 99, 101 are affixed to the rear connecting plate members 89 as described herein above for thereby supporting the inner form tube sections 89, 88 as shown. The mid wall sections 94, 96 include a tapered leading edge 94E, 96E respectively. As diagrammatically depicted and shown in FIG. 10, leading edges 94E, 96E are at an angle $\alpha$ with respect to the horizontal surface 44 and at the same angle $\alpha$ as discussed herein above in connection with the direction of travel of carrier 62. That is, leading edges 94E, 96E are parallel with the direction of travel of carrier 62 as depicted by arrow 148.

The upper crossover triangular section 102 includes a leading edge 102E terminating at a rear termination point 106. Similarly, the upper crossover triangular section 104 includes a leading edge 104E terminating at a rear termination point 108. The upper crossover triangular sections 102, 104 overlap one another as shown at the overlap area 110 and, more particularly, section 104 and its termination point 108 are located above/over section 102 and its termination point 106. As further described herein below, this overlap allows the plastic film edge 126 to be placed over the plastic film edge 128 for heat sealing purposes and forming the plastic film tube 47.

Mid wall section 94 defines an exterior surface 96X and an interior surface 96I. Similarly, mid wall section 96 defines an exterior surface 96X and an interior surface 96I. Left upper crossover triangular section 102 defines an exterior surface 102X and an interior surface 102I. Similarly, right upper crossover triangular section 104 defines an exterior surface 104X and an interior surface 104I.

Figure 11:
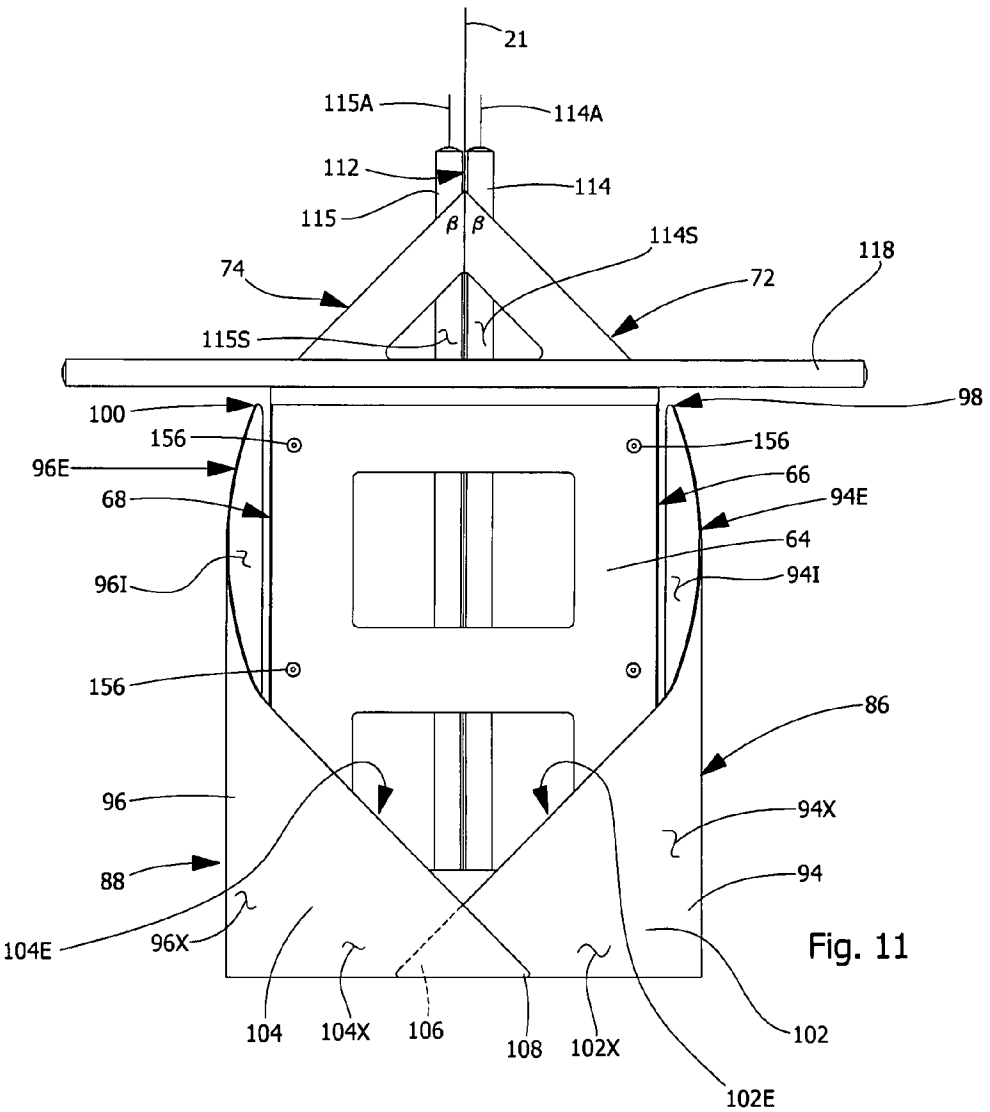
FIG. 11 is a top plan view of the film unfolding section and the inner form tube section shown in FIG. 9.

The film unfolding section 34 is located immediately below the plastic film forming tube 46 and conveyor 129. Film unfolding section 34 includes a guide plate 64 that is generally parallel with the upper conveying surface 130 of conveyor 129. Guide plate 64 includes left and right side edges 66, 68 that are curved upwardly and define upturned lips 66L, 68R respectively. Guide plate 64 also includes a forward triangular shaped end 70 and rear end 71. Forward end 70 includes left and right angular edges 72, 74 that are joined at a forward terminal point 76. Left angular edge 72 is joined with left side edge 66 and right angular edge 74 is joined with right side edge 68. Forward terminal point 76 is rounded or may additionally include a barb 78 that extends downwardly and between the longitudinally extending rollers 114, 115. Left and right side edges 66, 68 are parallel to one another and to the longitudinal line 21. Left and right angular edges 72, 74, as best seen in FIGS. 7 and 11, are at an angle β with respect to the longitudinal line 21. Additionally, angular edge 72 is parallel with pivot axes 50R, 62R of right pivot assemblies 60 and perpendicular with the pivot axes 48L, 62L of the left pivot assemblies 60. Angular edge 74 is parallel with pivot axes 48L, 62L of left pivot assemblies 60 and perpendicular with the pivot axes 50R, 62R of the right pivot assemblies 60.

Figure 10:
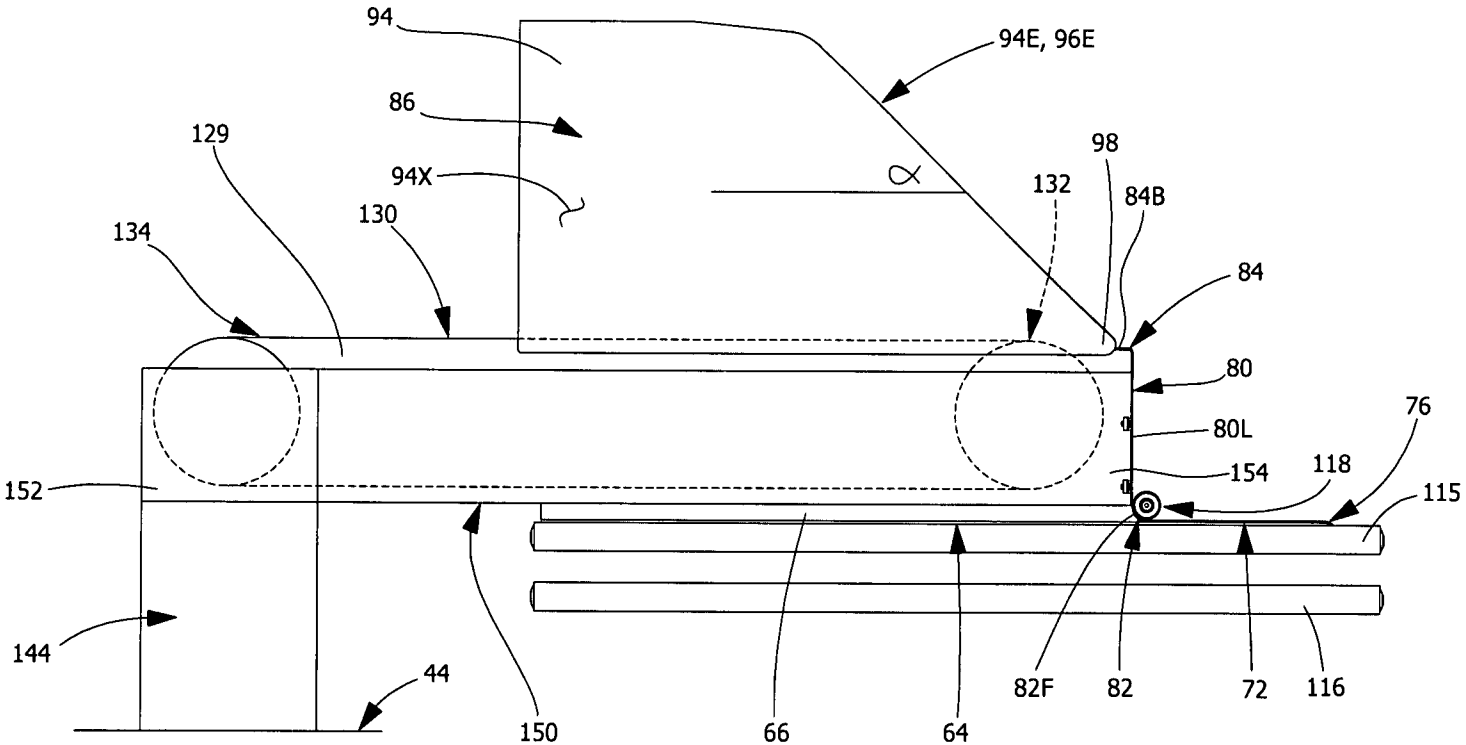
FIG. 10 is left side elevation view of the film unfolding section and the inner form tube section shown in FIG. 9 and diagrammatically depicting the cantilevered wrapper section conveyor and film guide plates.

A second or vertical guide plate 80 extends vertically upwardly and generally perpendicular to the guide plate 64. Vertical plate 80 includes a first lower edge 82, a second upper edge 84 and vertical side edges 80L and 80R. The left side edge 80L is adjacent the nosing 98 of left inner form tube section 86 and the right edge 80R is adjacent the nosing 100 of right inner from tube section 88. Lower edge 82 is adjacent to and can be affixed to the guide plate 64. Upper edge 84 includes a backwardly extending lip 84B that is curved towards the upper conveying surface 130 of conveyor 129. Lower edge 82 includes a forwardly extending lip 82F that is curved towards the forward triangular shaped end 70 of guide plate 64. As best seen in FIG. 10, triangular end 70 can be affixed or integrally formed with the vertical plate 80 and joined at the forwardly extending lip 82F.

An elongate guide member or roller 118 is located adjacent to the vertical plate member 80 and the forward end 70 of guide plate 64. Preferably, the outer diameter of roller 118 is substantially the same as the curvature of the forwardly extending lip 82F and lip 82F partially surrounds the roller 118 as best seen in FIG. 10. However, the outside surface 118S of roller 118 is sufficiently spaced from the guide plate forward end 70, the lip 82F and the vertical plate 80 such that plastic film 40 can readily and easily travel therebetween. Roller 118 is adapted to and rotates about axis 118A. Elongate guide member 118 is substantially perpendicular to the longitudinally extending rollers 114, 115 and the guide plate side edges 66, 68.

Figure 9:
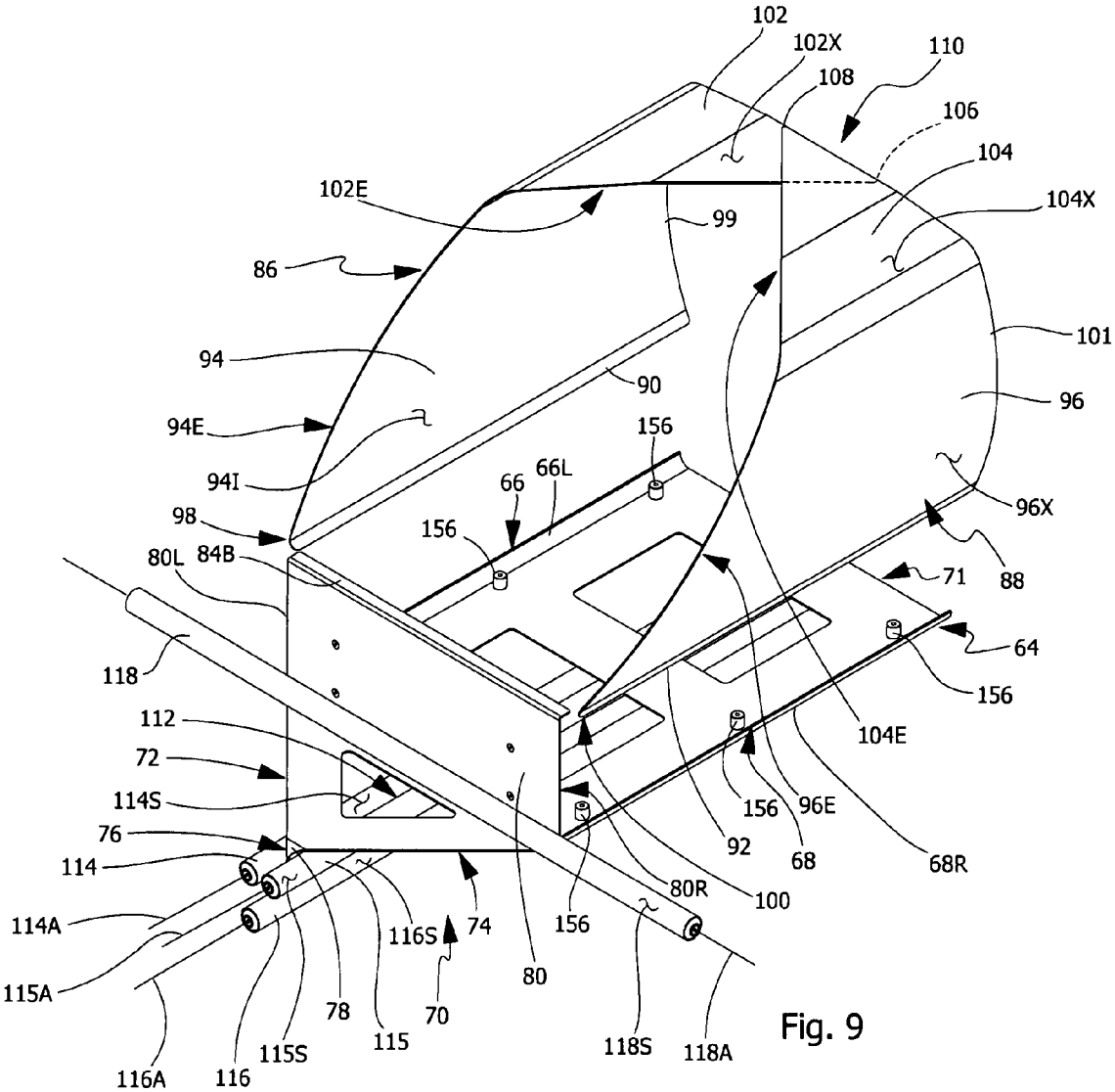
FIG. 9 is a front, right side and top perspective view of the film unfolding section and the inner form tube section shown in FIG. 7.

The longitudinally extending elongate guide members or roller 114 and 115 are parallel to one another and are located vertically below and adjacent the guide plate 64. The exterior surfaces 114S and 115S of rollers 114 and 115 respectively are spaced from each other so as to form an elongate slot 112 having a width such that plastic film 40 can readily and easily travel therethrough and between the roller 114, 155. Barb 78 of the guide plate 64 extends downwardly between roller 114, 115 and to the elongate slot 115 as best seen in FIG. 9. Rollers 114, 115 are adapted to rotate about their longitudinal axes 114A, 115A respectively. Additionally, rollers 114, 115 are substantially parallel with left and right side edges 66, 68 of the guide plate 64 and have a longitudinal length which is greater than the width W of the folded plastic film 40 on the plastic film roll 14.

Figure 6:
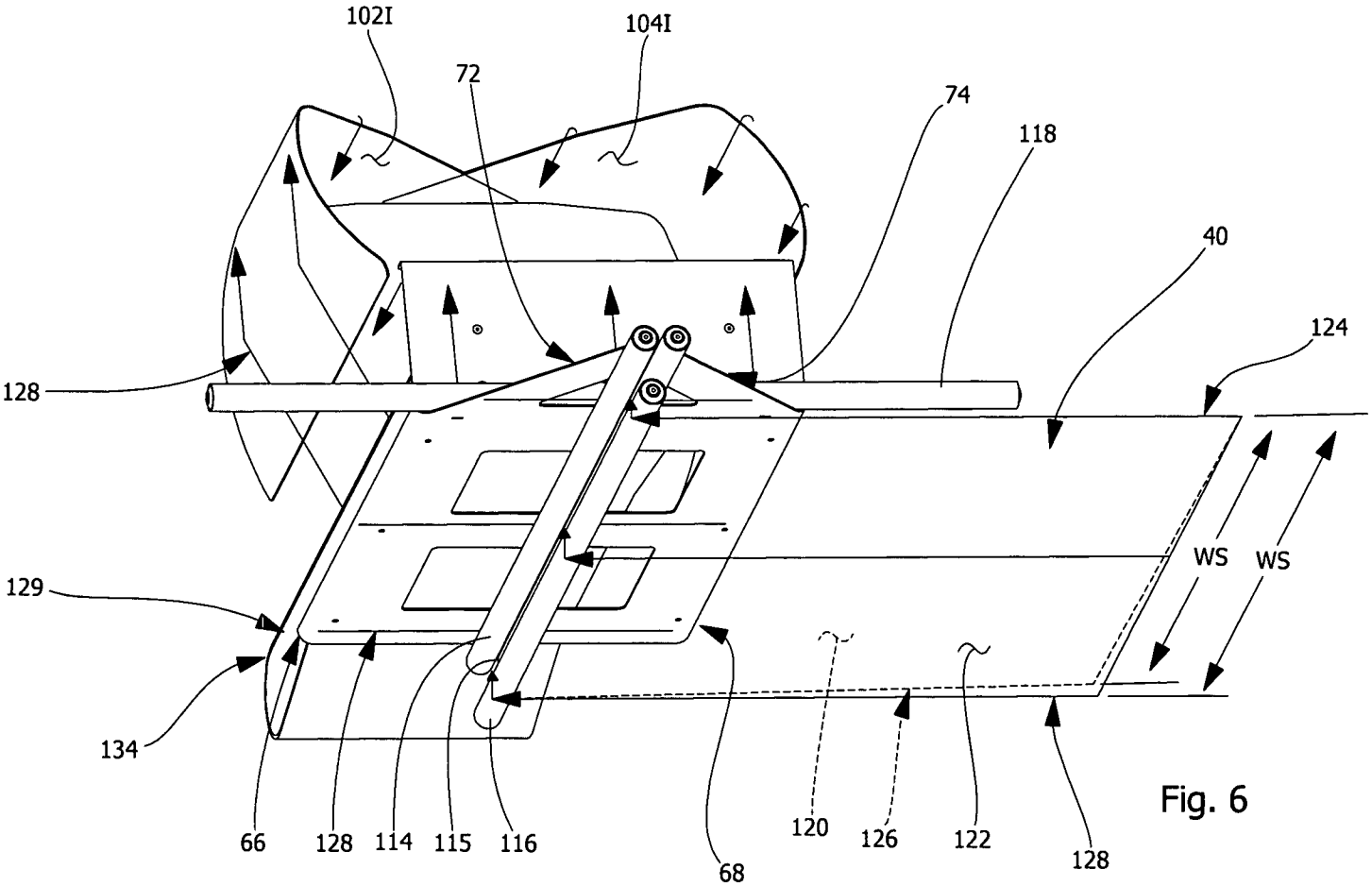
FIG. 6 is a front, left side and bottom perspective view of the film unfolding section and the tube forming section shown in FIG. 4.

A longitudinally extending elongate guide member or roller 116 is located below rollers 114, 155 and is substantially parallel therewith. Guide roller 116 is adapted to rotate about longitudinal axis 116A and has an exterior surface 116S. Roller 116, similar to rollers 114, 115, has a longitudinal length which is greater than the width W of the folded plastic film 40 on the film roll 14. As shown in FIGS. 6 and 12, lower guide roller 116 is located vertically directly below one of the rollers 114, 115 with its exterior surface 116A vertically below and aligned with the elongate slot 112.

Figure 4:
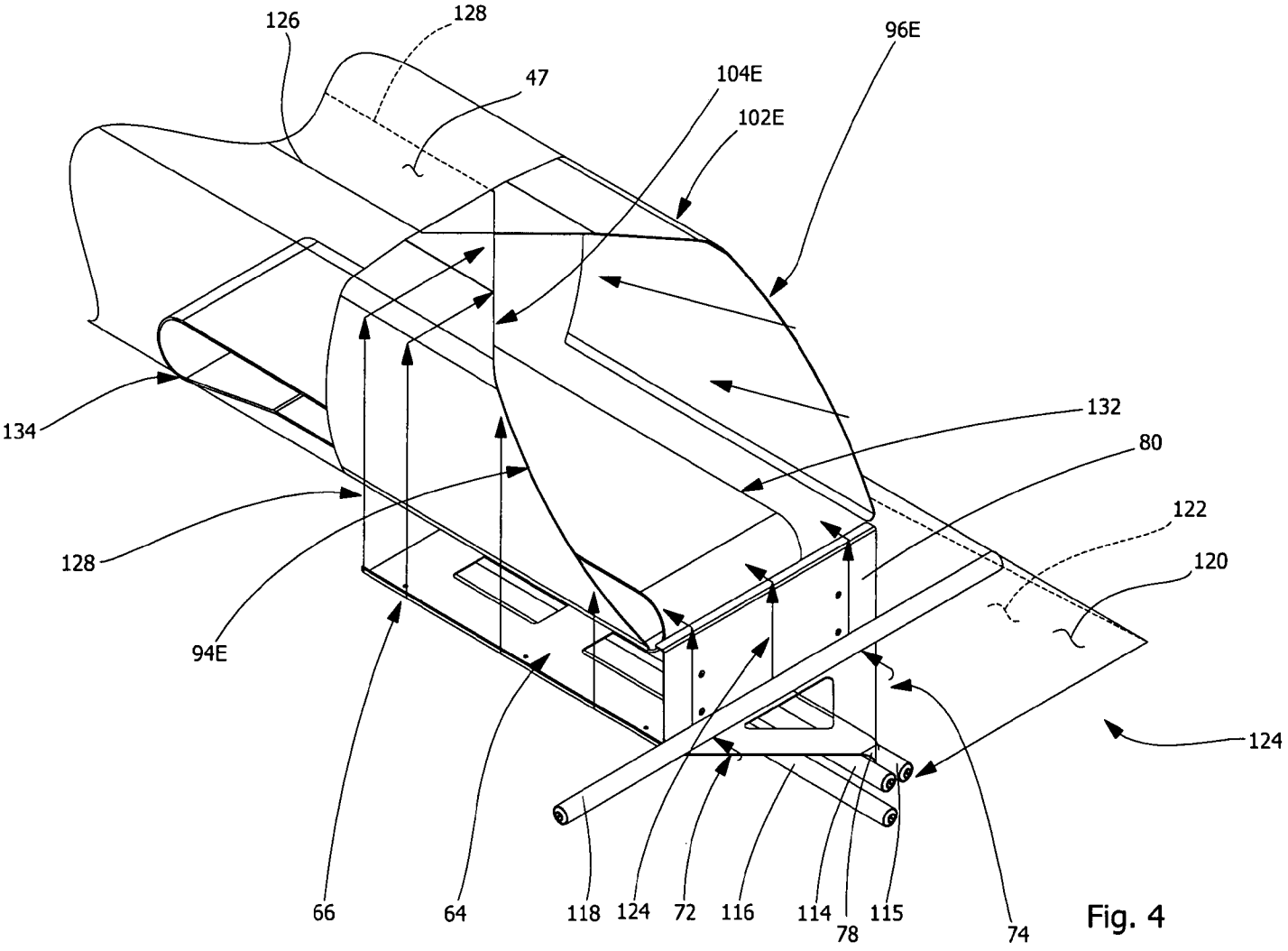
FIG. 4 is a front, left side and top perspective diagrammatic view of the film unfolding section and the tube forming section incorporated in the machine of FIG. 1 and constructed in accordance with the principles of the present invention.
Figure 5:
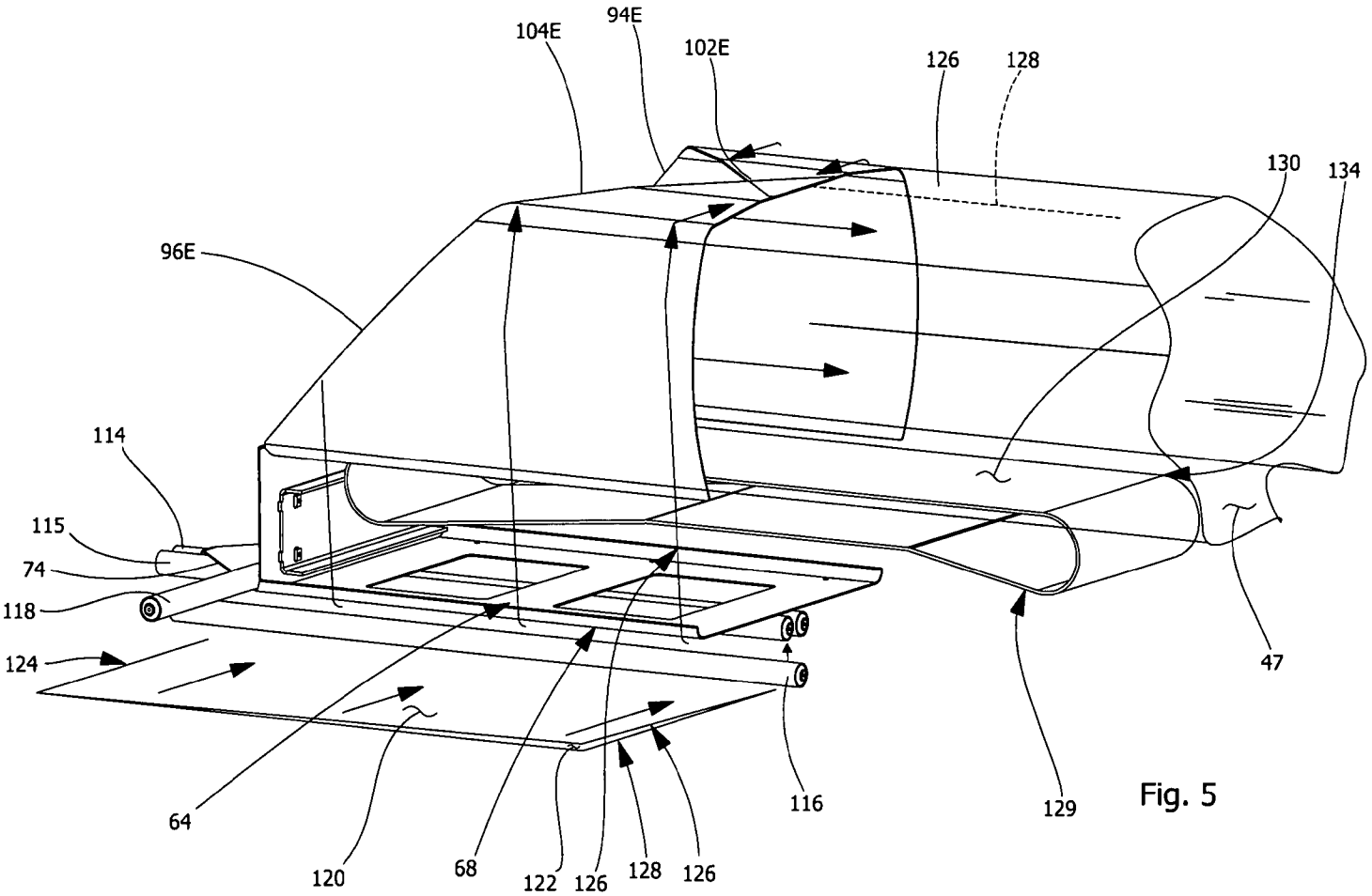
FIG. 5 is a rear, right side and top perspective view of the film unfolding section and the tube forming section shown in FIG. 4.

Referring now more particularly to FIGS. 4-6, the conveyor 129 is located immediately above guide plate 64 and below the plastic film forming tube 46. That is, conveyer 129 is generally sandwiched between the guide plate 64 and the forming tube 46. Conveyor 129, as mentioned herein above, includes a conveying surface 130. Conveyor 129 further includes a receiving end 132 and an outlet end 134. Receiving end 132 is adjacent the inlet orifice 56 and outlet end 134 is adjacent the outlet orifice 58. In the preferred embodiment as mentioned herein above, conveying surface 130 is provided on an endless belt conveyor 129; however, conveying surface 130 can be any low-friction surface whereupon the plastic film 40 and bales 16 can easily be traversed.

Wrapper section conveyer 129, guide plate 64 and vertical plate 80 are mounted on the frame 144 of the wrapper section 20 in a cantilever fashion. As shown diagrammatically in FIG. 10 and in the perspective view of the wrapper section in FIG. 12, horizontal cantilever beams 150 are provided on both sides of the conveyor 129 and are affixed, at their rear ends 152, to the frame 144. The beams forward ends 154 are therefore cantilevered from and extend out from the frame 144 as best depicted in FIG. 10. The vertical plate 80 is affixed to the forward ends 154 of the beams 150. The guide plate 64 is also affixed to the beams forward ends 154 such as with fasteners 156. The conveyor 129 is supported on and between the beams 150 with the conveyor receiving end 132 adjacent the beams forward ends 154 and the conveyor outlet end 134 adjacent the beams rear ends 152. As should now be appreciated, the conveyor receiving end 132, vertical plate 80 and guide plate 64 are cantilevered and extend between the forming collar 46 and the longitudinal rollers 114, 115 and 116. Hence, the plastic film 40 can be delivered from the rolls 14 normal to the longitudinal (the direction of travel of bales 16) of the apparatus 10 and underneath the film unfolding section 34 and tube forming section 36.

As best depicted in FIGS. 3-6, the plastic film 40 is provided on rolls 14 in a folded configuration wherein the overall folded width of the film/web is depicted by the letter W. In its folded configuration, plastic film or web 40 includes first and second sides 120, 122 joined along a longitudinal folded edge 124. As shown in FIG. 6, first plastic film side 120 has an outer or first longitudinal edge 126 and second plastic film side 122 has an outer or second longitudinal edge 128, and the two sides 120, 122 are joined along the longitudinal folded edge 124. The first and second sides 120, 122 are equal in size and have a width WS substantially equal to the plastic film roll width W. The width WS of each plastic film side 120, 122 is the distance between their respective outer first and second longitudinal edges 126, 128 and the longitudinal folded edge 124. Therefore, the overall total width of the plastic film/web 40 is two times that of the roll width W.

In operation, for unfolding the folded plastic film or web 40 as it is provided from roll 14 and forming it into a plastic film tube 47, the folded plastic film 40 is unwound from the roll 14 and is first delivered or travels around the guide roller 116 and up through the longitudinal slot 112 between the guide rollers 114, 115. The first plastic film side 120 then travels around the longitudinal guide roller 115 towards the right side edge 68 and the right angular edge 74 of guide plate 64. Similarly, the second plastic film side 122 travels around the longitudinal guide roller 114 towards the left side edge 66 and the left angular edge 72 of guide plate 64.

The part of the plastic film side 120 that travels to and slides around the guide plate side edge 68 (the "plastic film longitudinal right side") then travels generally vertically upwardly towards the right inner forming tube section 88; slides over the mid wall exterior surface 96X and the right crossover triangular section exterior surface 104X; around the tapered leading edges 96E and 104E of mid wall 96 and crossover triangular section 104 respectively; and, finally, along the mid wall interior surface 96I and the right crossover triangular section interior surface 104I. Similarly, the part of the plastic film side 122 that travels to and slides around the guide plate side edge 66 (the "plastic film longitudinal left side") then travels generally vertically upwardly towards the right inner forming tube section 86; slides over the mid wall exterior surface 94X and the right crossover triangular section exterior surface 102X; around the tapered leading edges 94E and 102E of mid wall 94 and crossover triangular section 102 respectively; and, finally, along the mid wall interior surface 941 and the right crossover triangular section interior surface 102I. Because the triangular section 104 is above the triangular section 102, the outer longitudinal edge 126 of the plastic film side 120 is located on top of the longitudinal edge 128 of the plastic film side 122 and, hence, on the exterior of the formed plastic tube 47.

The part of the plastic film side 120 adjacent the folded edge 124 that travels over the right angular edge 74 and the plastic film side 122 adjacent the folded edge 124 that travels over the left angular edge 72 (the "plastic film longitudinal middle section"), as best seen in FIG. 4, then travels: over the top of the guide plate forward triangular end 70: around the guide roller 118; vertically upwardly along the vertical plate 89; over the vertical plate upper edge 84; and, finally, onto the conveyor surface 130 of conveyor 129. It is noted that the longitudinal folded edge 124 travels: through the elongate slot 112 between guide rollers 114, 115; over the barb 78 at the guide plate forward terminal point 76; over the top and at the center of the guide plate forward triangular end 70: around the guide roller 118; vertically upwardly and along the vertical plate 89; over the vertical plate upper edge 84; and, finally, onto about the center of the conveyor surface 130 of conveyor 129.

As should now be appreciated, the plastic film tube 47 is thus formed by the plastic film longitudinal middle section traveling along the conveyor surface 130, the plastic film longitudinal left side traveling along the interior surfaces of the left inner form tube section 86 and the plastic film longitudinal right side traveling along the interior surfaces of the right inner form tube section 88. Additionally, as bales 16 are received through the forming tube inlet orifice 56, they traverse onto the plastic film longitudinal middle section over the conveyor surface 130 and into the central cavity 57 whereby they are enveloped within the plastic film tube 47. The plastic film overlapping edges 120, 122 are then heat sealed and the tube 47 is cut and sealed between individual bales with sealing section 23 for individually sealing each bale 16.

Advantageously, as should now also be appreciated, the left and right forming collar shoulder sections 48, 50 pivot about their respective pivot assemblies 60 and slide vertically upwardly and backwardly along the cam assemblies 138 for thereby receiving and wrapping variable sized bales 16 and for accommodating and wrapping bales which are not centered left/right on the conveyor surface 130. More particularly, the forming collar 46, in its retracted position as shown in FIGS. 4-11, will produce its smallest size plastic tube 47 defined by the size of the inner form tube sections 86, 88 and conveying surface 130. However, as best shown in FIGS. 14-17, the forming tube shoulder sections 48, 50 and their inner form tube sections 86, 88 pivot about their respective pivot assemblies 60 and slide vertically upwardly and backwardly along the cam assemblies 138 to expanded positions dictated by the size of the bales 16 and their left/right position on the conveyor surface for thereby forming an appropriate larger size plastic tube that will fit snugly on the bale 16.

Figure 14:
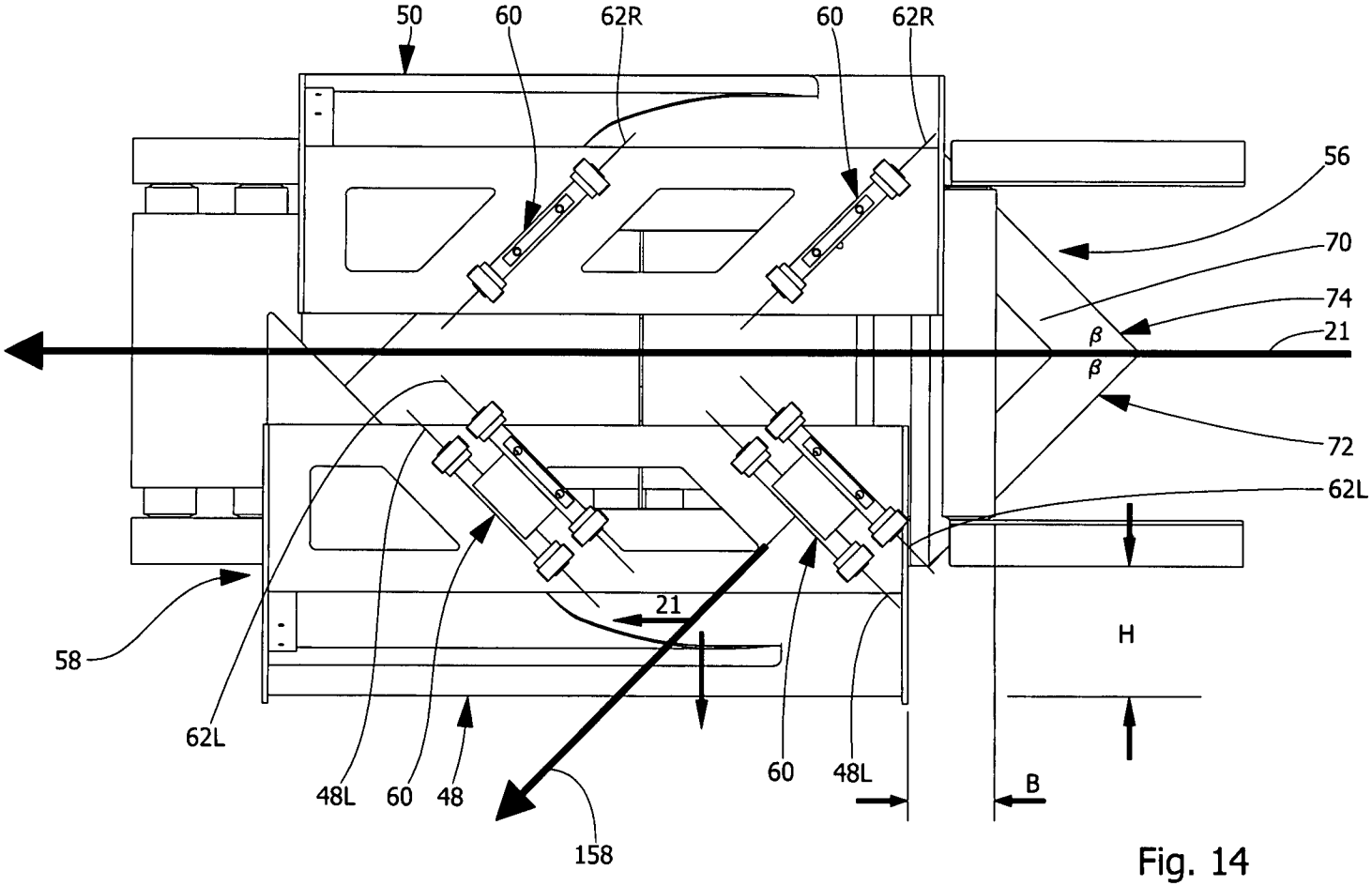
FIG. 14 is diagrammatic top plan view of the forming collar and guide plate forward triangular end with the forming collar carriage removed, and depicting the left shoulder section pivoted about its pivot assemblies and in an expanded position.
Figure 17:
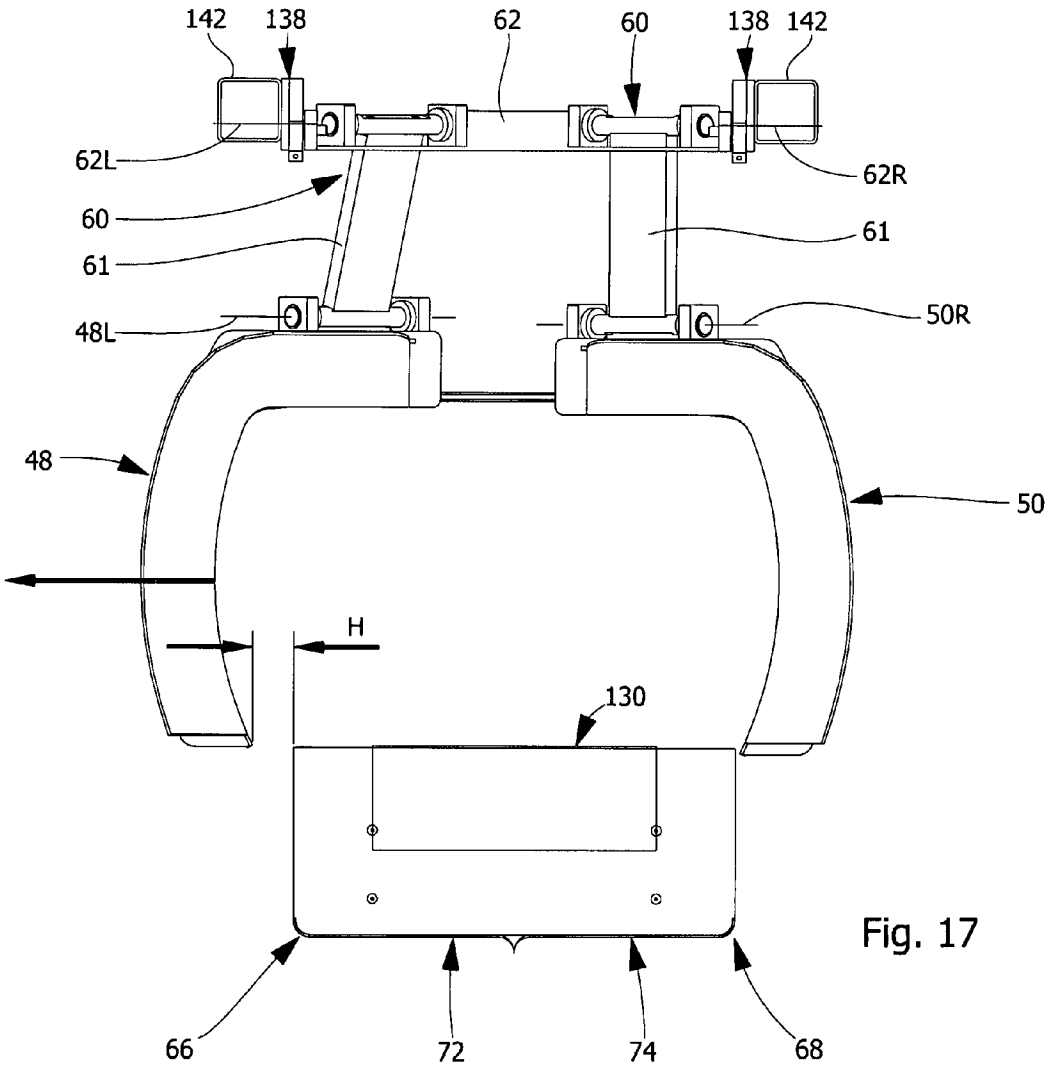

As shown in FIGS. 14 and 17, when a larger bale 16 or a bale which is, for example, located more toward the left side of the conveyor comes in contact with the lead-in guide 52, the left collar shoulder section 48 will pivot about its pivot assemblies 60 and travel upwardly and backwardly in a direction depicted by arrow 158. The direction of arrow 158 is ideally parallel to the left angular edge 72 of the guide plate forward triangular shape 70 and also parallel to the left inner forming collar leading edge 94E, and the pivot assemblies 60 and length of arms 61 are adapted to produce movement of the left shoulder section approximately, but not exactly, in the direction of arrow 158. Accordingly, shoulder section 48 will move backwardly a distance B and a corresponding vertical distance V and a leftward horizontal distance H, and the plastic tube 47 that will be formed over the bale will correspond thereto and fit snugly thereon. The right shoulder section 50, as described hereinabove, will move independent of shoulder section 48 about its pivot assemblies 60 causing shoulder section 50 to similarly move by a bale 16 contacting its lead-in guide 54 a vertical distance V but a rightward horizontal distance H. Therefore, with both shoulder sections 48, 50 in their maximum expanded positions as a result of pivoting about pivot assemblies 60, the forming collar/tube 46 will form a plastic tube 47 and accommodate a bale having a width equal to the forming collar retracted position width plus twice the horizontal distance H and a height equal to the forming collar height plus the vertical distance V.

Figure 15:
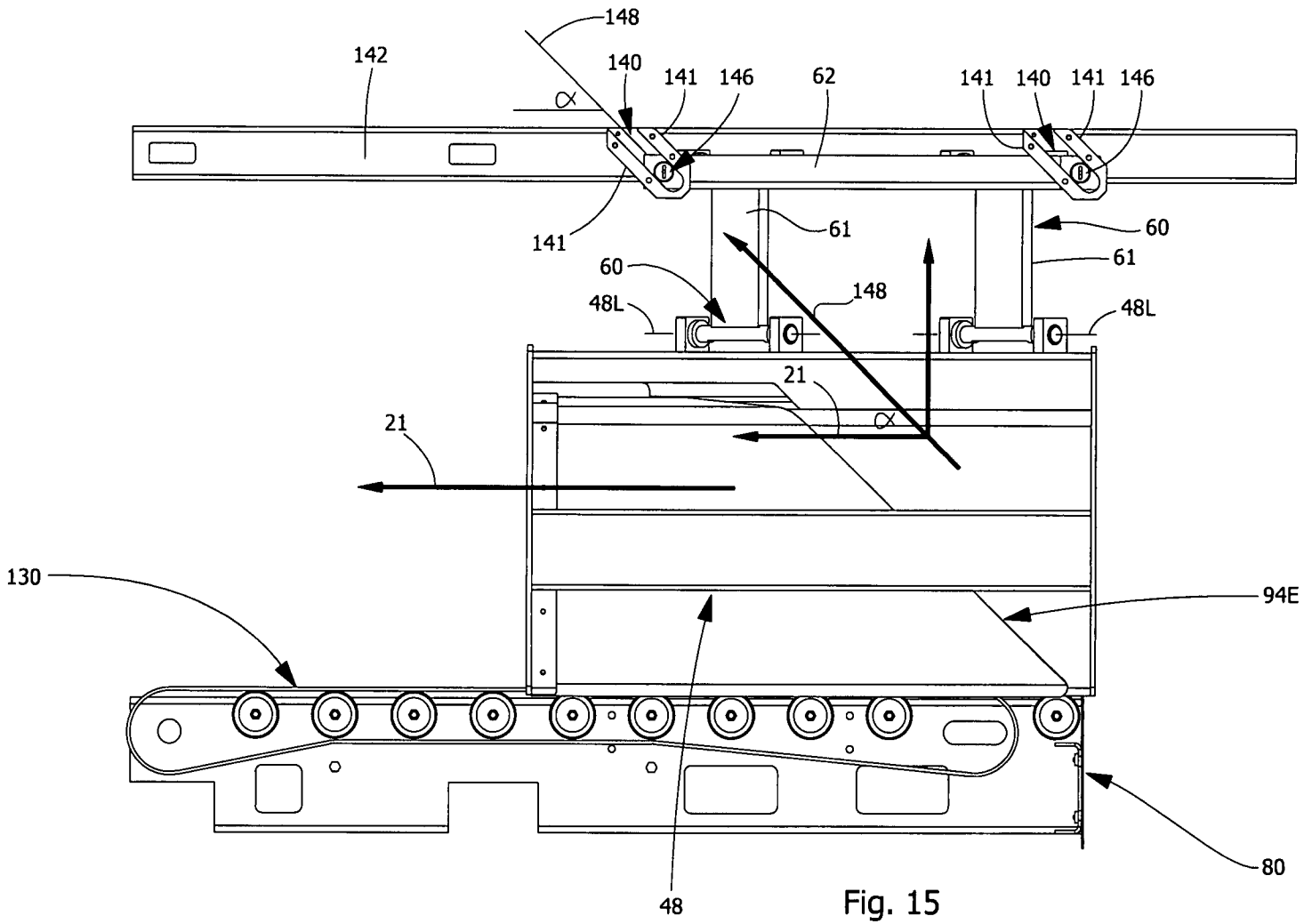
FIG. 15 is a diagrammatic side elevation view of the forming collar and showing the left shoulder section in its retracted position.
Figure 16:
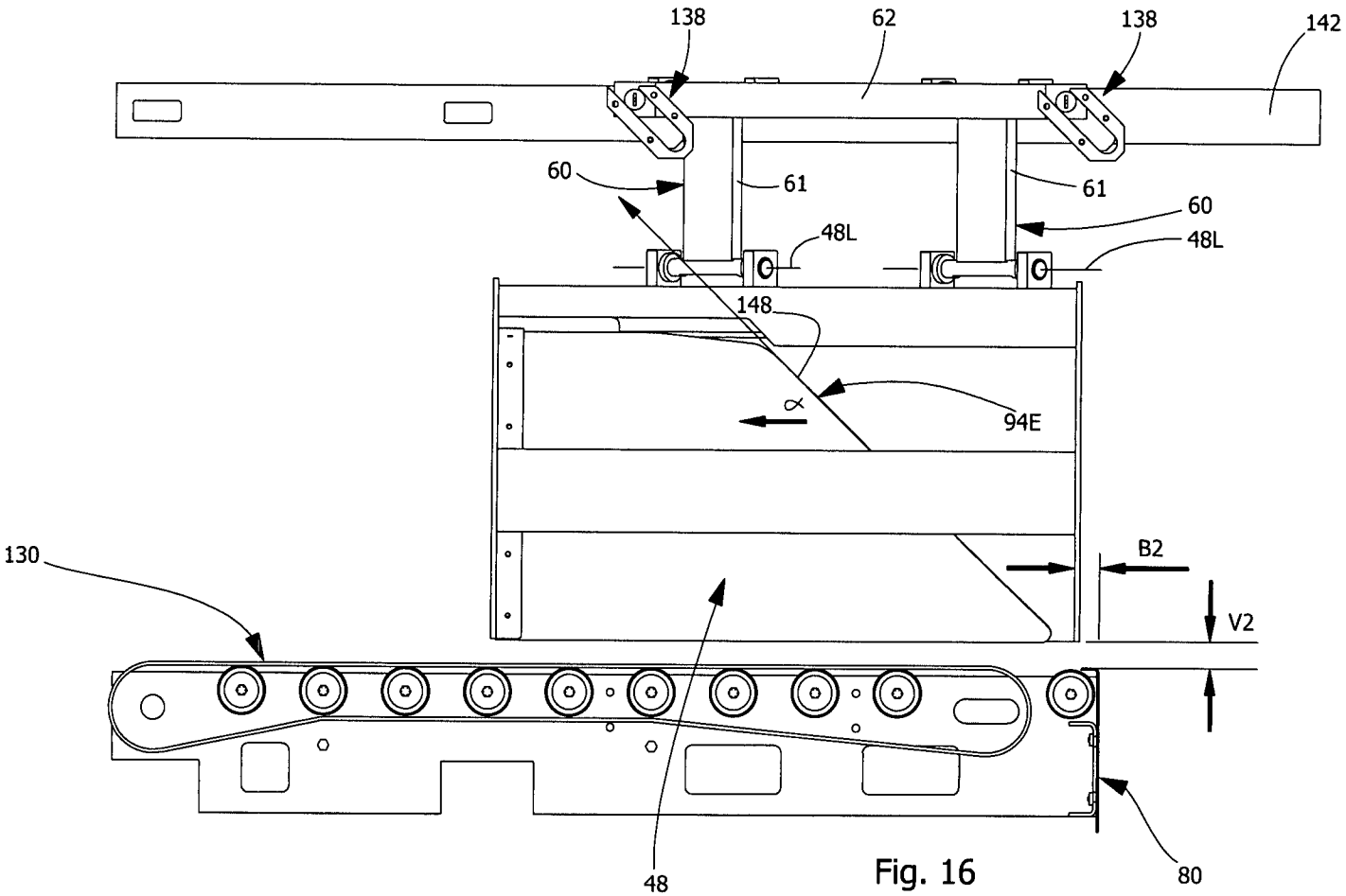
FIG. 16 is a diagrammatic side elevation view similar to FIG. 15 but showing the left shoulder section in its expanded position moved upwardly and backwardly; and, FIG. 17 is a diagrammatic front elevation view of the forming collar shown in FIG. 14 depicting the left shoulder section pivoted about its pivot assemblies and in an expanded position.

So as to accommodate bales which are yet taller in height, as described hereinabove, both shoulder sections 48, 50 are pivotally supported with their respective pivot assemblies 60 on the common carriage 62 which is itself moveable vertically upwardly and backwardly along the cam assemblies 138. More particularly, as best seen in FIGS. 15 and 16 wherein the left and right shoulder sections are shown not pivoted about their pivot assemblies 60, in their retracted positions the shoulder sections 48, 50 are relatively close to conveyor surface 130 (FIG. 15). However, when a taller bale 16 comes in contact with one or both the lead-in guides 52, 54, the carriage 62 along with both the left and right collar shoulder sections 48, 50 will slide and travel via the cam assemblies 138 upwardly and backwardly in a direction depicted by arrow 148. Accordingly, carrier 62 and shoulder section 48, 50 will move backwardly a distance B2 and vertically upwardly a distance V2, and the plastic tube 47 that will be formed over the bale will correspond thereto and fit snugly thereon. Therefore, with both shoulder sections 48, 50 not pivoted about their pivot assemblies 60, in their maximum expanded positions as a result of the carriage traveling along the cam assemblies 138, the forming collar/tube 46 will form a plastic tube 47 and accommodate a bale having a height equal to the forming collar retracted position height plus a vertical distance of V2.

Finally, with both shoulder sections 48, 50 in their maximum expanded positions as a result of pivoting about pivot assemblies 60 as well as a result of the carriage traveling along the cam assemblies 138, the forming collar/tube 46 will form a plastic tube 47 and accommodate a bale having a width equal to the forming collar retracted position width plus twice the horizontal distance H and a height equal to the forming collar height plus the vertical distances V and V2.

While this invention has been described as having an exemplary design, the present invention may be further modified within the spirit and scope of this disclosure. This application is therefore intended to cover any variations, uses, or adaptations of the invention using its general principles.

What is claimed is:

1. An apparatus for unfolding a folded plastic film for use in forming a tube, wherein the plastic film includes a first side joined to a second side along a longitudinal folded edge and wherein each side includes an outer longitudinal edge, said apparatus comprising:

an elongate slot adapted to receive the plastic film;

a guide plate adjacent said elongate slot and including a forward end and a left and a right side edge;

an elongate guide member adjacent said guide plate;

a forming collar adjacent said guide plate; and, wherein after the plastic film is received through said elongate slot, part of the first side of the plastic film travels toward and over said guide plate left side edge and onto said forming collar and part of the second side of the plastic film travels toward and over said guide plate right side edge and onto said forming collar, and the longitudinal folded edge and part of both the first and second sides of the plastic film adjacent the longitudinal folded edge travel toward and over said guide plate forward end and around said elongate guide member.

2. The apparatus of claim 1 wherein said elongate slot is formed with a pair of longitudinally extending rollers.

3. The apparatus of claim 2 wherein said pair of longitudinally extending rollers are substantially parallel to each other.

4. The apparatus of claim 3 wherein said guide plate left and right side edges are substantially parallel to said pair of longitudinally extending rollers.

5. The apparatus of claim 4 wherein said elongate guide member is substantially perpendicular to said guide plate left and right side edges.

6. The apparatus of claim 5 wherein said elongate guide member comprises a roller.

7. The apparatus of claim 5 wherein said guide plate forward end includes a left angular edge and a right angular edge, said left and right angular edges are joined at a forward terminal point and said left angular edge is joined with said left side edge and said right angular edge is joined with said right side edge, and wherein the plastic film longitudinal folded edge travels over said forward terminal point.

8. The apparatus of claim 7 wherein a barb is provided at said forward terminal point extending toward said elongate slot and between said pair of longitudinally extending rollers.

9. The apparatus of claim 7 further comprising a second guide plate, said guide second plate including an edge generally parallel with said elongate guide member and wherein the plastic film longitudinal folded edge and part of both the first and second sides of the plastic film adjacent the longitudinal folded edge travel over said second guide plate after traveling around said elongate guide member.

10. The apparatus of claim 7 further comprising:

a second guide plate adjacent said elongate guide member;

a conveyor adjacent said second guide plate;

wherein said forming collar is also adjacent said conveyor; and, wherein the parts of the first and second sides of the plastic film traveling over said guide plate left and right side edges travel toward and over said forming collar and wherein the plastic film longitudinal folded edge and part of both the first and second sides of the plastic film adjacent the longitudinal folded edge traveling over the elongate guide member travel toward and over said second guide plate and onto said conveyor.

11. The apparatus of claim 10 wherein said second guide plate includes a first edge generally parallel with said elongate guide member and a second edge generally parallel with a supporting surface on said conveyor.

12. The apparatus of claim 10 wherein said conveyor includes a receiving end and an outlet end and wherein said conveyor is cantilevered with its outlet end being supported and its receiving end extending between said guide plate and said forming collar.

13. The apparatus of claim 10 wherein said forming collar includes separable left and right form tube sections.

14. The apparatus of claim 1 wherein said elongate slot is substantially parallel to said guide plate left and right side edges and said elongate guide member is substantially perpendicular to said guide plate left and right side edges.

15. The apparatus of claim 1 wherein said elongate slot is substantially parallel to said guide plate left and right side edges.

16. The apparatus of claim 1 wherein said elongate guide member is substantially perpendicular to said guide plate left and right side edges.

17. The apparatus of claim 1 wherein said guide plate forward end includes a left angular edge and a right angular edge, wherein said left and right angular edges are joined at a forward terminal point and said left angular edge is joined with said left side edge and said right angular edge is joined with said right side edge, and wherein the plastic film longitudinal folded edge travels over said forward terminal point.

18. The apparatus of claim 17 wherein a barb is provided at said forward terminal point extending toward and into said elongate slot.

19. The apparatus of claim 1 further comprising a second guide plate, said guide second plate including an edge generally parallel with said elongate guide member and wherein the plastic film longitudinal folded edge and part of both the first and second sides of the plastic film adjacent the longitudinal folded edge travel over said second guide plate after traveling around said elongate guide member.

20. The apparatus of claim 1 further comprising:

a second guide plate adjacent said elongate guide member;

a conveying surface said second guide plate;

wherein said forming collar is also adjacent said conveying surface; and, wherein the parts of the first and second sides of the plastic film traveling over said guide plate left and right side edges travel toward and over said forming collar and wherein the plastic film longitudinal folded edge and part of both the first and second sides of the plastic film adjacent the longitudinal folded edge traveling over the elongate guide member travel toward and over said second guide plate and onto said conveying surface.

21. The apparatus of claim 20 wherein said second guide plate includes a first edge generally parallel with said elongate guide member and a second edge generally parallel with conveying surface.

22. The apparatus of claim 20 wherein said conveying surface includes a receiving end and an outlet end and wherein said conveying surface receiving end extends between said guide plate and said forming collar.

23. The apparatus of claim 20 wherein said forming collar includes separable left and right form tube sections.

24. A method of unfolding a folded plastic film for use in forming a tube, wherein the plastic film includes a first side joined to a second side along a longitudinal folded edge, wherein each side includes an outer longitudinal edge and wherein said sides are parallel and adjacent one another, said method comprising:

initially separating the plastic film first and second sides at their respective outer longitudinal edges;

conveying a plastic film longitudinal left side comprising part of the first side adjacent its outer longitudinal edge toward and over a guide plate left side edge and then over a left form tube section;

conveying a plastic film longitudinal right side comprising part of the second side adjacent its outer longitudinal edge toward and over a guide plate right side edge and then over a right form tube section;

conveying a plastic film longitudinal middle section comprising the longitudinal folded edge and part of both the first and second sides adjacent the longitudinal folded edge toward and over an angular edge which is located at an angle relative to the guide plate side edges and then onto a carrying surface; and, wherein after said conveying of said longitudinal middle section over said angular edge and prior to conveying said longitudinal middle section onto the carrying surface, said longitudinal middle section travels over an elongate guide member.

25. The method of claim 24 wherein, after said longitudinal middle section travels over the elongate guide member, it travels along a second guide plate extending between the elongate guide member and the carrying surface.

26. The method of claim 24 wherein the directions of travel of said plastic film longitudinal middle section prior to and after traveling over the elongate member are substantially perpendicular to one another.

27. The method of claim 24 wherein, prior to the step of initially separating, the folded plastic film travels through an elongate slot.

28. The method of claim 27 wherein, immediately after said step of initially separating, the plastic film longitudinal left and right sides are conveyed in a direction substantially perpendicular to the direction that said plastic film longitudinal middle section is being conveyed.

29. The method of claim 24 wherein conveying of said longitudinal middle section toward said angular edge is in a direction opposite that of the conveying of said longitudinal middle section on said carrying surface.

* * * * *